United States Patent [19]

Ishihara et al.

[11] Patent Number: 4,669,963

[45] Date of Patent: Jun. 2, 1987

[54] ROLLING PISTON TYPE ROTARY MACHINE

[75] Inventors: Nobuaki Ishihara, Kariya; Toshihiro Takei, Okazaki; Yoshiyuki Hattori, Toyoake; Koji Okazaki, Kariya, all of Japan

[73] Assignee: Nippondenso Co., Ltd., Kariya, Japan

[21] Appl. No.: 798,021

[22] Filed: Nov. 14, 1985

[30] Foreign Application Priority Data

Nov. 15, 1984 [JP] Japan ..... 59-242069
Oct. 24, 1985 [JP] Japan ..... 60-237989
Oct. 24, 1985 [JP] Japan ..... 60-237990

[51] Int. Cl.[4] ..... F01C 1/356; F04C 18/356
[52] U.S. Cl. ..... 418/65; 418/251
[58] Field of Search ..... 418/63, 65, 251, 184, 418/183

[56] References Cited

U.S. PATENT DOCUMENTS 1,054,210 2/1913 Kinney ..... 418/65
1,623,378 4/1927 Bavington ..... 418/65

FOREIGN PATENT DOCUMENTS 784899 5/1935 France ..... 418/65
56-75997 6/1981 Japan .
56-53105 12/1981 Japan .

*Primary Examiner*—John J. Vrablik
*Attorney, Agent, or Firm*—Cushman, Darby & Cushman

[57] ABSTRACT

A rotary piston vacuum pump has a rotor eccentrically disposed in a cylinder and mounted therein for revolution in rolling contact with the cylindrical inner peripehral surface of the cylinder so that a crescent-shaped space is defined between the rotor and the cylinder and moved around the axis of the cylinder. A vane is radially reciprocally mounted in a vane chamber having an inner end open to the cylindrical inner peripheral surface of the cylinder. The vane has an inner end in sliding contact with the outer peripheral surface of the rotor to divide the crescent-shaped space into a suction chamber in communication with a suction port and a discharge port to be communicated with a discharge port having an inner end open in a wall of an outer part of the vane chamber. The rate of communication between the discharge port and the discharge chamber through the outer vane chamber part is varied by the reciprocal movement of the vane so that the communication is interrupted at least when the point of contact between the rotor and the cylinder inner peripheral surface reaches the vane.

3 Claims, 19 Drawing Figures

ROLLING PISTON TYPE ROTARY MACHINE

BACKGROUND OF THE INVENTION

The present invention relates to a rolling piston type rotary machine operable as a vacuum pump which provides a vacuum source either to be installed in an automobile equipped with a Diesel engine or to be used as a brake booster of a vehicle.

In the conventional rolling piston type rotary machine, suction and discharge ports are formed in a cylinder on the opposite sides of a vane. When a rotor is brought to a position in which the point of contact between the outer surface of the rotor and the inner peripheral surface of the cylinder is positioned between the suction and discharge ports, the suction and discharge ports are communicated with each other through a crescent-shaped space defined between the rotor and the cylinder and positioned at this moment at a place remote from the vane. In the case where the rotor is revolved at a high speed, there is a possibility that a check valve is not operative to follow the high speed revolution of the rotor, with a resultant disadvantage that the check valve fails to sufficiently seal a discharge port against the atmospheric pressure. In such an event, the atmospheric air flows through the discharge port back into the space between the rotor and the cylinder. In consequence, the machine produces noise, requires an increased magnitude of driving torque and creates a lowered level of vacuum. The present invention has its object to eliminate the communication between the suction and discharge ports which is caused in the prior art due to the failure of the check valve operation.

SUMMARY OF THE INVENTION

According to one feature of the present invention, there is provided a rolling piston type rotary machine which comprises a cylinder having a cylindrical inner peripheral surface, a rotor disposed in the cylinder in eccentric relationship to the axis of the cylinder and mounted for revolution in rolling contact with the cylindrical inner peripheral surface of said cylinder. The cylinder is formed therein with a vane chamber having an inner part open substantially radially in the cylindrical inner peripheral surface of the cylinder. The cylinder and the rotor cooperate to define therebetween a generally crescent-shaped space movable about the axis of the cylinder by the revolution of the rotor. The machine further includes a radially inwardly biased vane slidably mounted in the vane chamber and having an inner end in sliding contact with the outer peripheral surface of the rotor so that the vane is reciprocally moved as the rotor is revolved.

The vane divides the crescent-shaped space into a suction chamber and a discharge chamber. The vane chamber has an outer part into and out of which the vane is reciprocally moved. The cylinder is further formed therein with a suction port adapted to be open to the suction chamber and a discharge port having an inner end adapted to be opened to the outer part of the vane chamber when the vane is moved toward the crescent-shaped space. The inner part of the vane chamber and the vane are so shaped as to define therebetween a substantially radial communication passage through which the discharge chamber is adapted to be communicated with the outer part of the vane chamber. The discharge port is so positioned relative to the vane that the area of the opening of the discharge port to the outer part of the vane chamber is varied by the reciprocal movement of the vane.

According to another feature of the invention, there is also provided a rolling piston type rotary machine which comprises a cylinder having a cylindrical inner peripheral surface, a rotor disposed in the cylinder in eccentric relationship to the axis of the cylinder and mounted for revolution in rolling contact with the cylindrical inner peripheral surface of the cylinder. The cylinder is formed therein with a vane chamber having an inner part open substantially radially in the cylindrical inner peripheral surface of the cylinder. The cylinder and the rotor cooperate to define therebetween a generally crescent-shaped space movable about the axis of the cylinder by the revolution of the rotor. The machine further includes a radially inwardly biased vane slidably mounted in the vane chamber and having an inner end in sliding contact with the outer peripheral surface of the rotor so that the vane is reciprocally moved as the rotor is revolved. The vane divides the crescent-shaped space into a suction chamber and a discharge chamber. The vane chamber has an outer part into and out of which the vane is reciprocally moved. The cylinder is further formed therein with a suction port adapted to be open to the suction chamber and a discharge port communicated with the outer part of the vane chamber. The inner part of the vane chamber and said vane are so shaped as to define therebetween a substantially radial communication passage through which the discharge chamber is adapted to be communicated with the outer part of the vane chamber. The communication passage is so arranged that the communication between the discharge chamber and the outer part of the vane chamber is interrupted at least when the point of contact between the rotor and the inner peripheral surface of the cylinder reaches the vane.

The above and other objects, features and advantages of the present invention will be made more apparent by the following description of preferred embodiments of the invention with reference to the accompanying drawings.

DESCRIPTION OF THE PREFERRED EMBODIMENTS

A vacuum pump for a brake booster embodying the rolling piston type rotary machine of the invention will be described hereinunder.

Figure 1:
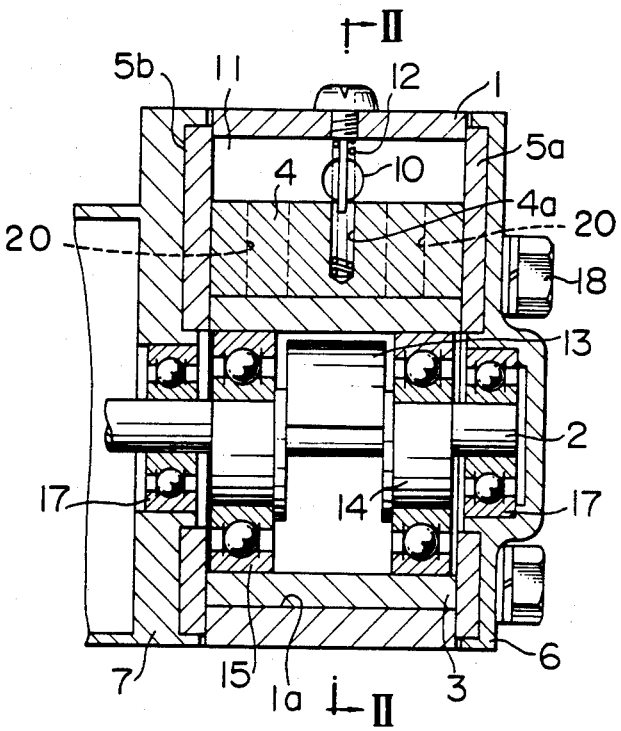
FIG. 1 is an axial sectional view of an embodiment of the rolling piston type rotary machine according to the present invention.
Figure 2:
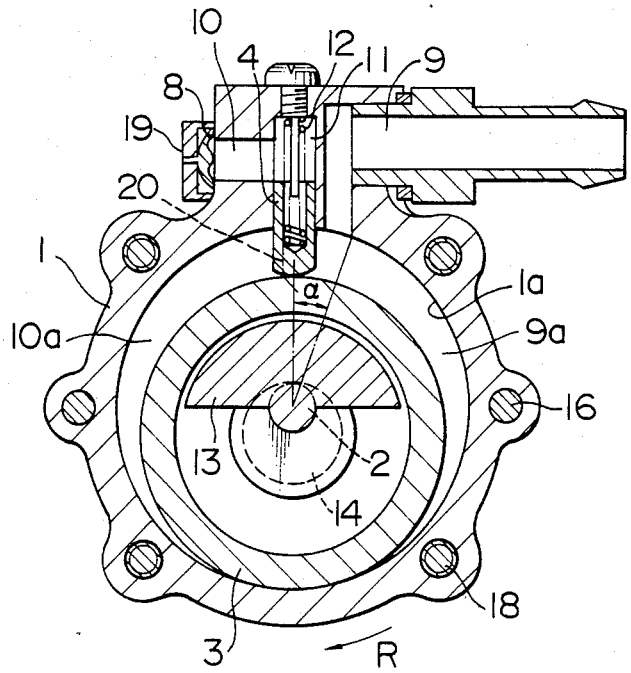
FIG. 2 is a cross-sectional view of the rotary machine taken along line II—II in FIG. 1.

Referring to FIGS. 1 and 2, the vacuum pump has a main shaft 2 which is supported at both ends by a front housing part 6 and a rear housing part 7 through respective ball bearings 17. A balancer 13 for smoothing the rotation of the main shaft 2 is provided on the central portion of the main shaft 2. The main shaft 2 also has a pair of eccentric bosses 14 formed on both axial sides of the balancer 13 with a predetermined amount of eccentricity from the axis of the main shaft 2. The eccentric bosses 14 carry a cylindrical rotor 3 through the intermediary of ball bearings 15. A casing 1 having a cylindrical inner surface 1*a* is clamped between the front housing part 6 and the rear housing part 7. The axis of the cylindrical inner surface 1*a* of the casing 1 is offset by a predetermined distance from the axis of the rotor 3. End plates 5*a* and 5*b* are disposed between the front and rear housing parts 6 and 7 and the adjacent axial ends of the rotor 3, respectively. The casing 1 and the end plates 5*a* and 5*b* constitute in combination a cylinder.

The casing 1 is formed therein with an axially and radially extending vane chamber 11 which slidably receives a plate-shaped vane 4. The vane 4 is formed therein with a spring hole 4*a*. A spring 12 is received in the spring hole 4*a* in contact with the inner surface of the opposing wall of the vane chamber 11 so as to bias the vane 4 inwardly and thereby normally keep the vane 4 in sliding contact with the outer peripheral surface of the rotor 3. The arrangement is such that the vane 4 reciprocatingly slides in the vane chamber 11 in accordance with the revolution of the rotor 3 within the cylinder in the direction of an arrow R in FIG. 2. A crescent-shaped cylinder chamber is defined by the inner peripheral surface of the cylinder and the outer peripheral surface of the rotor 3 and is divided by the vane 4 into a suction chamber 9*a* and a discharge chamber 10*a*. The casing 1 is provided with a suction port 9 through which air is sucked into the suction chamber 9*a*, and with a discharge port 10 open to an outer part of the vane chamber 11 and adapted to allow air to be discharged from the discharge chamber 10*a*. The discharge port 10 is provided with a check valve 8 retained by a valve retainer 19 and adapted to allow only the air discharged from the discharge port to pass therethrough. The position of the discharge port 10 is determined in the manner which will be explained later. The end plates 5*a* and 5*b* are located on the front and rear housing parts 6 and 7 by means of locating pins 16. The front housing part 6, the casing 1 and the rear housing part 7 are assembled together and fastened to one another by means of tie bolts 18.

Figure 3:
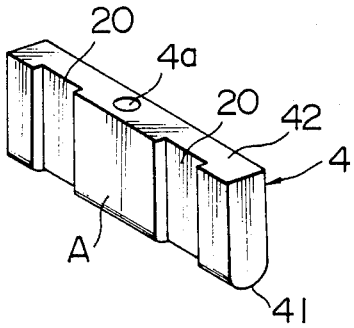
FIG. 3 is a perspective view of a vane.

An example of the construction of the vane 4 will be described hereinunder with specific reference to FIG. 3. The vane 4 is constituted by a plate-shaped member having an arcuate end surface 41 for making sliding contact with the outer peripheral surface of the rotor 3, while the aforementioned spring hole 4*a* is formed to extend into the vane 4 from the other end surface 42 thereof. A pair of channel grooves 20 of predetermined depth and width are formed in the surface of the vane 4 facing the discharge port 10. These channel grooves 20 extend between both end surfaces 41 and 42 of the vane 4. The vane 4 moves back and forth within the vane chamber 11 in accordance with the rotation of the rotor 3. The position of the discharge port 10 is determined such that the land portion A on the vane 4 between both channel grooves 20 faces the discharge port 10 when the vane 4 has been retracted into the vane chamber 11. It will be seen that the opening area of the discharge port 10 is changed in accordance with the amount of lap between the land portion A and the discharge port 10 in accordance with the reciprocating motion of the vane 4. Accordingly, the position of the discharge port 10 is so selected that the discharge port 10 is completely closed by the land portion A on the vane 4 during the period from the time when the vane 4 is retracted most into the vane chamber 11 to the time when the vane 4 projects a predetermined distance into the cylinder chamber. The "predetermined distance" mentioned above is the distance which the vane 4 projects into the cylinder chamber when the rotor 3 has rotated through an angle $\alpha$ from the uppermost position (not shown) as viewed in FIG. 2 in the direction of an arrow R in FIG. 2, the angle $\alpha$ being the angle formed between a line which interconnects the center of the main shaft 2 and the center of the vane 4 and a line which interconnects the center of the main shaft 2 and the trailing edge of the suction port 9 which opens in the inner peripheral surface 1*a* of the casing 1. In other words, the predetermined distance mentioned above is the distance travelled by the vane 4 during the period while the rotor rotates from the uppermost position (not shown) as viewed in FIG. 2 to a position where the point of sliding contact between the rotor 3 and the inner peripheral surface 1*a* of the casing 1 is moved just past the opening of the suction port 9.

With regard to the constituent materials of the major parts, the casing 1 and the eccentric rotor 3 are made of a material or materials such as teflon-coated iron, an aluminum composite material (FRM) reinforced with carbon fibers or whiskers of SiC or $Si_3N_4$ and so forth. Such a material preferably has the coefficient of thermal expansion the same as that of the ball bearings 15. The vane 4 may be made of sintered carbon impregnated with resin, while end plates 5 may be formed from sintered carbon impregnated with a metal.

The operation of the described rolling piston type machine is as follows:

The main shaft 2 is driven by the power of a suitable prime mover which is not shown. The rotation of the main shaft 2 causes eccentric rotation of the eccentric bosses 14 about the axis of the main shaft 2. Since the eccentric rotor 3 is rotatably carried by the eccentric bosses 14 through the ball bearings 15, the eccentric rotation of the eccentric bosses 14 causes the rotor 3 to revolve in rolling and sliding contact with the inner peripheral surface 1*a* of the casing 1 in the direction of the arrow R in FIG. 2. Meanwhile, the vane 4, which is held in sliding contact with the outer peripheral surface of the rotor 3, is made to reciprocate within the vane chamber 11. In consequence, the volumes of the suction chamber 9a and the discharge chamber 10a repeatedly increase and decrease, thus causing a pumping action. More specifically, the volume of the suction chamber 9a is progressively increased from the moment at which the point of sliding contact between the rotor 3 and the inner surface 1a of the casing 1 has just passed the opening of the suction port 9 to the moment at which the rotor 3 reaches the uppermost position as viewed in FIG. 2, so that air in a vacuum tank (not shown) of a brake booster is sucked into the suction chamber 9a through the suction port 9. As the rotor 3 further rotates, the rotor 3 finishes the suction of air. That is, the suction chamber 9a now serves as the discharge chamber 10a. The volume of this discharge chamber 10a is progressively decreased in accordance with the rotation of the rotor 3. While the rotor 3 rotates from the above-mentioned uppermost position to the lowermost position as viewed in FIG. 2, the vane 4 is progressively projected from the vane chamber 11 so that the amount of lap between the land portion A and the discharge port 10 is gradually decreased. More specifically, the opening area of the discharge port 10 is maximized when the rotor has reached the lowermost position. Then, as the rotor 3 revolves in the direction of the arrow R from the lowermost position towards the uppermost position, the vane 4 is progressively retracted deeper into the vane chamber 11 so that the area of lap between the land portion A and the discharge port 10 is increased to reduce the opening area of the discharge port. The discharge port 10 is completely closed by the land portion A of the vane 4 when the rotor 3 has reached a position which is $\alpha°$ before the uppermost position. The discharge port 10 is kept closed by the land portion A of the vane 4 until the rotor 3 revolves to a position which is $\alpha°$ beyond the uppermost position. Thus, there is no possibility that the suction port 9 and the discharge port 10 are communicated with each other during revolution of the rotor 3 from the uppermost position to the position where the rotor 3 has just passed the opening of the suction port 9.

Figure 4:
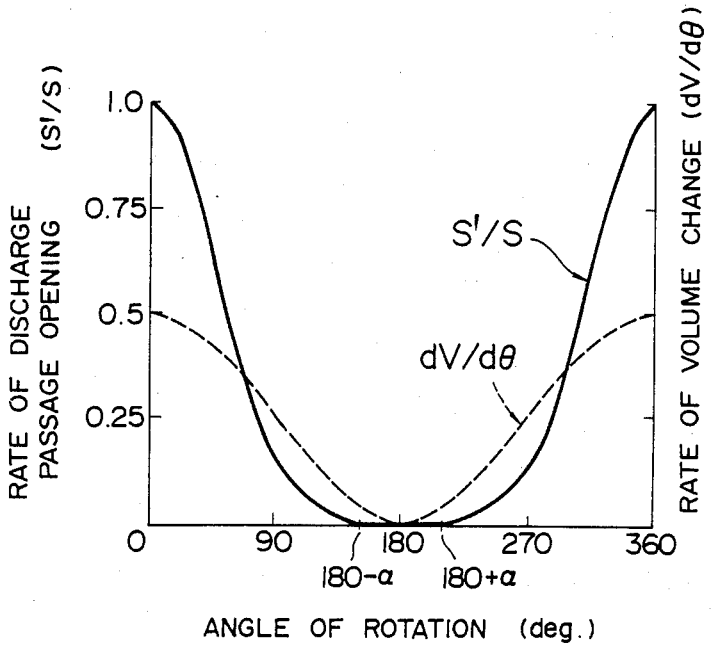
FIG. 4 graphically illustrates the operation characteristic of the rotary machine shown in FIGS. 1–3.

FIG. 4 graphically illustrates the opening ratio (S'/S) of the discharge port 10 and the rate of change in the volume of the discharge chamber 10a in relation to the angle $\theta$ of rotation of the eccentric bosses 14 from the angular position where the rotor 3 is in the lowermost position, i.e., the rotation angle $\theta$ is zero when the rotor 3 is in the lowermost position.

As will be understood from the graph, the discharge port 10 is kept closed when the rotor 3 is within the region from the position where the point of contact is $\alpha°$ before uppermost position ($\theta=180°-\alpha°$) to the position where the point of contact has just passed the suction port 9 ($\theta=180°+\alpha°$).

Figure 5:
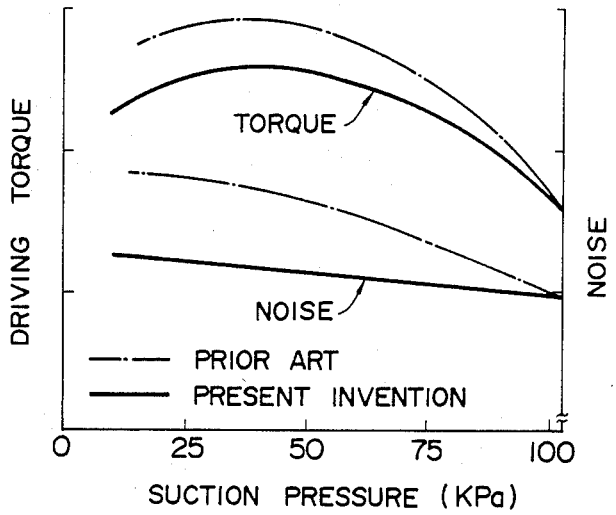
FIG. 5 graphically illustrates the results of tests in respect of noise level and required driving torque.

FIG. 5 shows the result of measurement of noise level and driving torque in the described embodiment of the rolling piston type machine and those in a prior art. As will be clearly seen from this Figure, the machine of the invention can operate with smaller driving torque and lower noise level than those of the machine of the prior art.

Figure 18:
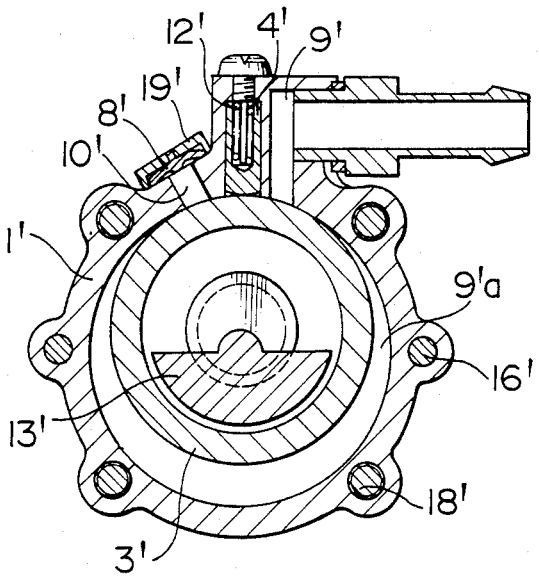
FIG. 18 PRIOR ART
FIG. 18 shows the rolling piston type rotary machine of the prior art.

FIG. 18 shows the rolling piston type rotary machine of the prior art, wherein the parts functionally equivalent to or similar to those of the embodiments of the present invention are designated by the same reference numerals added by primes (′). It will be seen that the suction ports 9′ and discharge port 10′ are disposed on the opposite sides of the vane 4′; namely, the suction port 9′ is disposed on the trailing side of the vane 4′ while the discharge port 10′ is disposed on the leading side of the vane 4′. Due to this structure, the prior art rotary machine has the problem which has been discussed in the introductory part of this specification. This problem is eliminated by the present invention, as will be understood from the graphical illustrations shown in FIGS. 4 and 5.

In the preceding embodiment of the invention, the discharge port 10 is closed by the land A of the vane 4 when the rotor 3 is positioned within the range between the position where the point of contact between the rotor and the cylindrical inner peripheral surface of the cylinder is $\alpha°$ in advance of the vane and the position where the point of contact is $\alpha°$ beyond vane. This arrangement, however, involves a risk of excessive compression of the air because the volume of the discharge chamber 10a continues to decrease even after the discharge port 10 has been closed at the rotation angle of $180°-\alpha°$.

Figure 6:
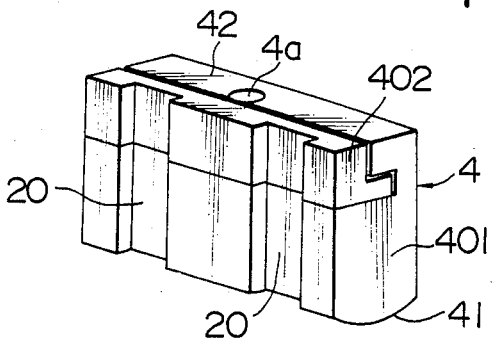
FIG. 6 is a perspective view of a vane of a second embodiment of the invention.
Figure 7A:
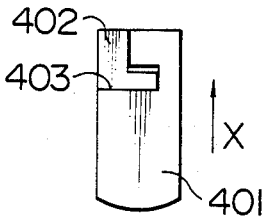
FIGS. 7A and 7B respectively show in ends views the vane of the second embodiment in different positions.
Figure 7B:
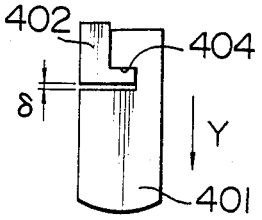
Figure 8:
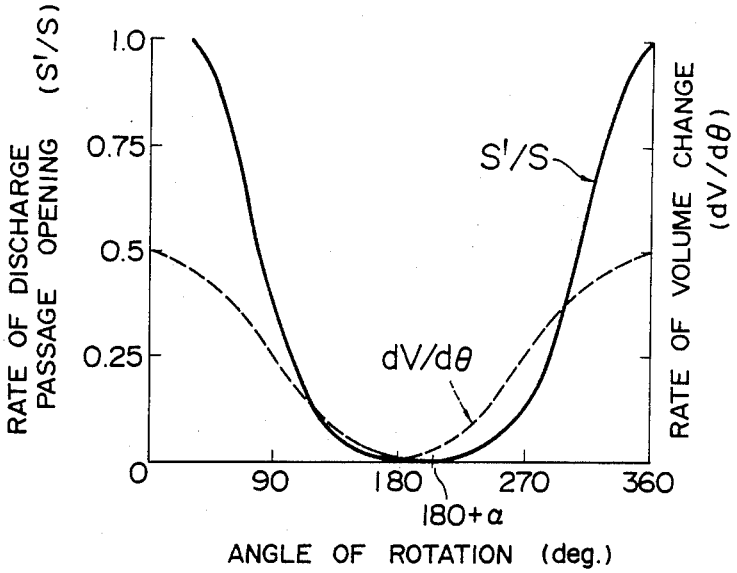
FIG. 8 graphically illustrates the operation characteristic of the rotary machine in which the vane shown in FIGS. 6–7B is incorporated.

This problem, however, can be overcome by a second embodiment of the invention. Referring to FIGS. 6 to 7B, the vane 4 used in the second embodiment of the rolling piston machine of the invention is composed of two parts: namely, a first vane member 401 and a second vane member 402. The first vane member 401 is provided in its end 42 remote from the rotor 3 with a recess having an L-shaped sectional shape, while the second vane member 402 has an L-shaped sectional shape substantially complementary to that of the recess in the first vane member 401. The second vane member 402 loosely fits in the recess in the first vane member 401. As shown in FIG. 7A, therefore, the second vane member 402 is pushed upwardly by the lower surface 403 of the recess in the first vane 401 when the vane 4 is moved in the direction of the arrow X, i.e. toward its uppermost position in the vane chamber 11, whereas, when the vane 4 is moved in the direction of the arrow Y, i.e. outwardly of the vane chamber 11, the second vane member 402 is pressed down by the upper surface 404 of the recess in the first vane member 401. This means that the effective height or vertical dimension of the vane 4 is increased by an amount equal to the play or gap $\delta$ between the first and second vane members 401 and 402. In this embodiment, the discharge port 10 is upwardly displaced or offset a distance equal to the gap from the location of the discharge port of the first embodiment and thus, closed when the rotation angle has reached 180° (see FIG. 8). However, when the vane 4 is being projected into the cylinder chamber, the period of closure of the discharge port 10 is prolonged, i.e., the timing of opening of the discharge port 10 is delayed, by an amount corresponding to the increment $\delta$ of the effective height of the vane 4 because vane member 402 closes the discharge port before being pressed down by upper surface 404. In consequence, the discharge port 10 is kept closed over the region between $\theta=180°$ and $\theta=180°+\alpha°$ in terms of the rotation angle of the eccentric bosses 14. The play or gap $\delta$ mentioned above may be determined to be equal to the height "H" to be explained later. In the second embodiment, the channel grooves 20 are formed to extend over two vane members 401 and 402. It will be understood that the second embodiment shown in FIGS. 6–7B is free from the problem of excessive compression of air to be discharged in the region from the position where the angle $\theta$ is 180° minus $\alpha$° to the position where the angle $\theta$ is 180 °.

The embodiments described hereinbefore provides an additional advantage that the discharge pressure which is introduced into the space in the vane chamber 11 above the vane 4 acts on the top of the vane 4 so as to urge the same downwardly into contact with the rotor 3, thus adding to the force of the compression coiled spring 12 in urging the vane 4. Therefore, the load on the spring 12 is decreased, so that the size of the same can be reduced.

Figure 9:
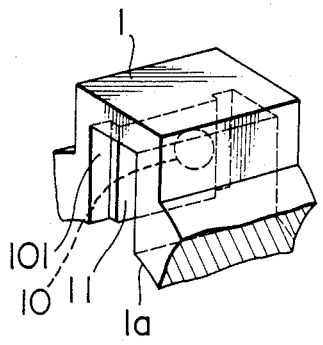
FIG. 9 is a fragmentary perspective view of a modified cylinder.

The embodiments described with reference to FIGS. 1–3 and 6–7B can be modified in various forms. For instance, the channel grooves 20 constituting a part of the discharge passage may be formed in the wall of the casing 1 as denoted by 101 in FIG. 9. The same effect can also be obtained when one of the channel grooves 101 is formed in the wall of the casing 1, while the other channel groove 20 is formed in the surface of the vane 4.

Figure 10:
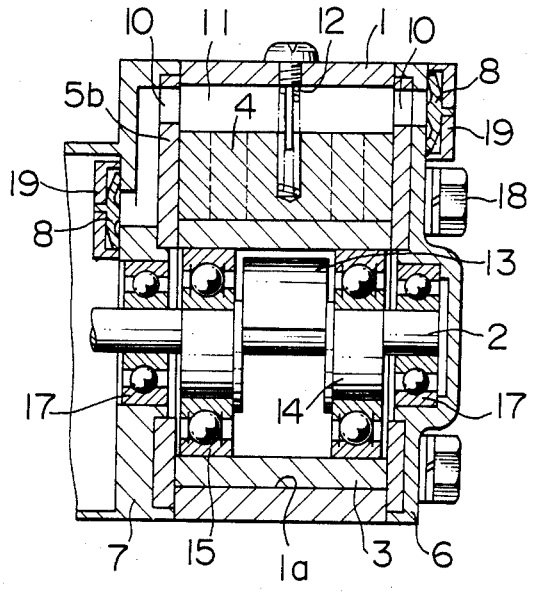
FIG. 10 is a view similar to FIG. 1 but illustrates a further modification to the cylinder.

In the described embodiments, the discharge port 10 extends from the vane chamber 11 through the casing 1, but the discharge port 10 may alternatively be formed in either one or both of the end plates 5*a* and 5*b*, as shown in FIG. 10.

The umbrella-type check valve 8 provided in the described embodiments can be replaced by a poppet-type valve or a reed valve.

The casing 1, the end plates 5*a* and 5*b* and the front and rear housing part 6 and 7 may be fixed independently, although these parts are assembled as a unit in the described embodiments.

The described embodiments are driven directly by a prime mover. However, the power may be transmitted through a pulley or other suitable power transmission means from another power source.

It is also possible to use needle bearings or self-lubricating bushings in place of the ball bearings 15 through which the rotor 3 is mounted on the eccentric bosses 14.

In the embodiments described above, the period over which the discharge port 10 is kept closed depends upon the position of the discharge port 10 with respect to the vane 4. This, however, is not exclusive and the timing or period of the interruption of the communication between the discharge chamber 10*a* and the discharge port 10 may be adjusted by varying the length of the channel grooves formed in the vane 4. More specifically, referring to FIG. 12, the channel grooves 20 are formed to open at their one ends in the end surface 42 of the vane 4 remote from the rotor 3 and terminate at their other ends at a distance or height "H" from the vane end 41 adjacent the rotor 3. This height "H" corresponds to the distance travelled by the vane 4 from the moment when the rotor 3 is in the uppermost position to the moment when the point of contact between the rotor 3 and the inner peripheral surface 1*a* of the casing 1 passes the opening of the suction port 9. Thus, the channel grooves 20 are completely concealed by the surface of the adjacent wall of the inner part of the vane chamber 11 and, therefore, the outer part of the vane chamber 11 is kept isolated from the discharge chamber 10*a* during the period while the amount of projection of the vane 4 into the cylinder chamber is less that the afore-mentioned height "H".

Figure 11:
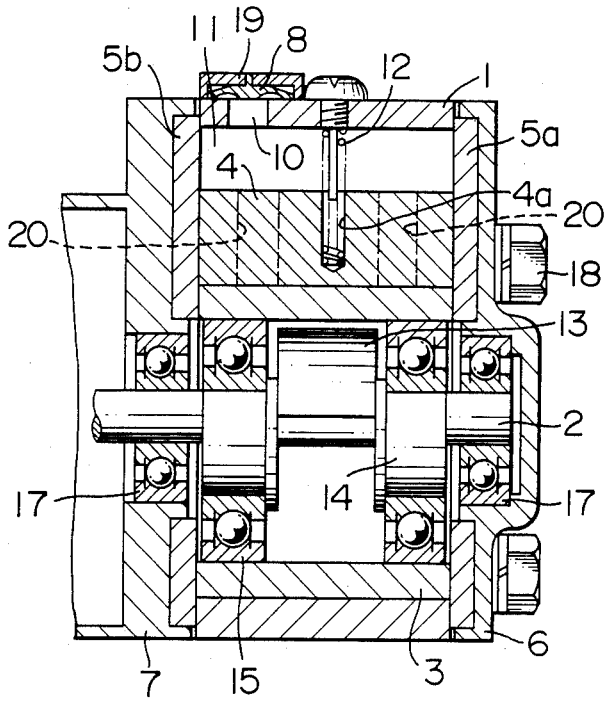
FIG. 11 is similar to FIGS. 1 and 10 but shows a further modified cylinder.
Figure 12:
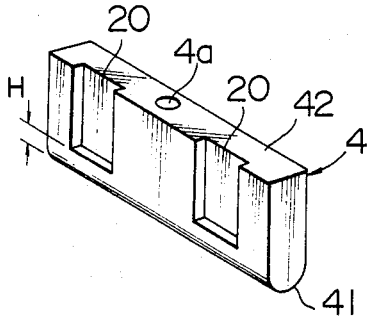
FIGS. 12 and 13 are perspective views of further modified vanes, respectively.

The vane of the type shown in FIG. 12 can preferably be used in a rolling piston rotary machine of the design shown in FIG. 11 wherein the discharge port 10 is formed in the top wall of the vane chamber 11 so that the discharge port 10 is always communicated with the upper or radially outer part of the vane chamber 11. It will be understood that the communication between the discharge chamber 10*a* and the outer part of the vane chamber 11 is varied by the reciprocal movement of the vane 4.

Figure 13:
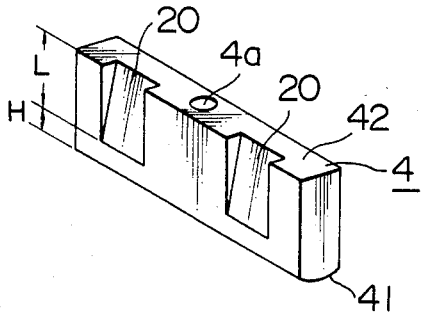

FIG. 13 shows a further embodiment which employs a different form of the vane 4 suited for use with the machine shown in FIG. 11. In this embodiment, the channel grooves 20 start at a height "H" from the end surface 41 of the vane 4 adjacent the rotor 3 and open in the other end surface 42, as in the embodiment shown in FIG. 12, but the depth of the channel grooves 20 shown in FIG. 13 is progressively increased from their lower starting ends towards the ends open in the end surface 42 of the vane 4. These channel grooves 20 define, in cooperation with the surface of the wall of the inner part of the vane chamber 11, a communication passage which provides a communication between the discharge chamber 10*a* and the outer part of the vane chamber 11. The effective area of the communication passage formed by the channel grooves 20 and the inner surface of the wall of the vane chamber 11 is progressively varied in accordance with the change in the amount of projection of the vane 4 from the vane chamber 11. More specifically, when the vane 4 is fully retracted in the vane chamber 11, the portion of the vane 4 extending within the height "H" devoid of the channel grooves 20 is held in contact with the inner surface of the inner part of the vane chamber 11 so that the aforementioned communication passage is disconnected from the discharge chamber 10*a*. The communication passage is allowed to communicate with the discharge chamber 10*a* only after the vane has been projected by a distance "H" and, as the vane 4 is further projected, the effective area of the communication passage is progressively increased in accordance with the increase in the distance which the vane 4 projects into the cylinder chamber. Thus, the area of the communication passage is maximized when the distance of projection of the vane 4 is maximized. Conversely, when the vane 4 is being moved into the vane chamber 11, the effective area of the above-mentioned communication passage is progressively decreased. Thus, the vane of this embodiment may preferably be used in the machine shown in FIG. 11.

In other words, the effective area of the communication passage is progressively increased in accordance with the revolution of the rotor from the uppermost position to the lowermost position as viewed in FIG. 11 and is progressively decreased in accordance with the revolution of the rotor 3 from the lowermost position to the uppermost position as viewed in FIG. 11. When the volume of the discharge chamber 10*a* is reduced substantially to zero, i.e., when the rotor 3 has been brought to the uppermost position, the effective area of the communication passage becomes substantially zero, thus disconnecting the vane chamber 11 from the discharge chamber 10*a*. The effective area of the communication passage is substantially zero during the time period while the amount of projection of the vane 4 is within the range of the height "H" mentioned before. The angle $\alpha$ of revolution of the rotor 3 corresponds to the height "H", so that the communication passage is closed when the rotor 3 is positioned within the range of from $\alpha$° before to $\alpha$° after the uppermost position of the rotor.

Figure 14:
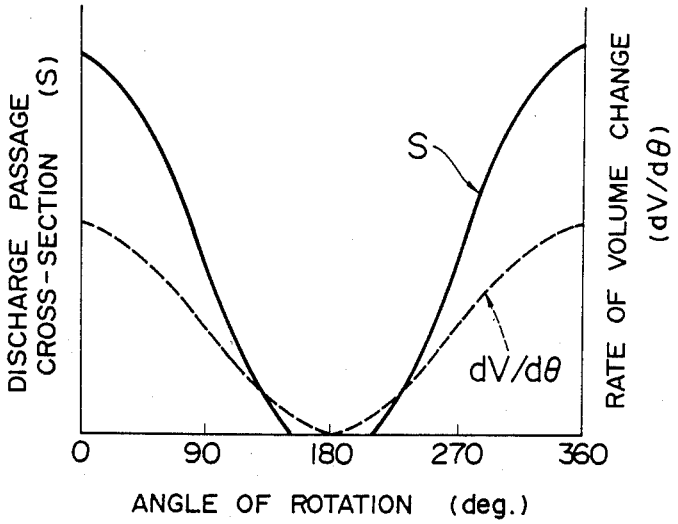
FIG. 14 graphically illustrates the operation characteristic of the machine in which the vane shown in FIG. 13 is incorporated.

FIG. 14 shows the effective area S of the communication passage and the rate of volume change ($dv/d\theta$) in relation to the revolution angle of the rotor 3, i.e., the rotation angle $\theta$ of the eccentric bosses 14. The rotation angle $\theta$ when the rotor 3 is in the lowermost position as viewed in FIG. 11 is determined to be 0° and the rotation angle $\theta$ when the rotor 3 is in the uppermost position as viewed in FIG. 2 is determined to be 180°. From this Figure, it will be seen that the effective area S of the communication passage is decreased in accordance with the decrease in the rate of volume change ($dV/d\theta$) of the discharge chamber 10*a* and that the effective area S is zero when the rotation angle $\theta$ is around 180°.

Figure 15:
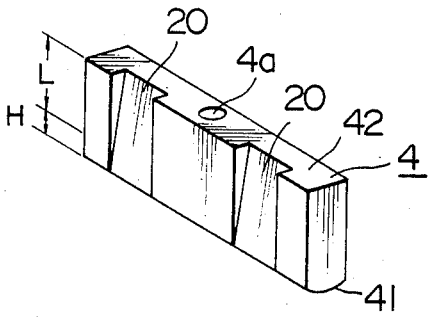
FIGS. 15–17 are perspective views of further modified vanes, respectively.

In a further modification shown in FIG. 15, the channel grooves 20 are modified to extend from the edge of the end surface 41 adjacent the rotor and to the other end surface 42 of the vane 4. In this case, the communication passage is closed only when the rotor 3 has been moved to the uppermost position in FIG. 2, i.e., only when the vane 4 has been fully moved into the vane chamber 11. According to this arrangement, it is possible to continue the discharging of the fluid through the communication passage until the volume of the discharge chamber 10*a* is fully decreased, thus attaining a high volumetric efficiency of the machine.

Figure 16:
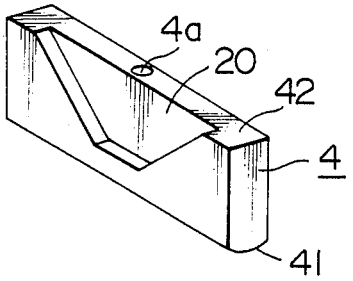
Figure 17:
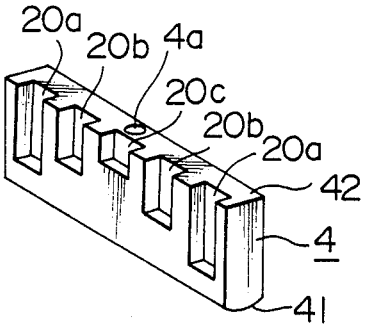

FIGS. 16 and 17 show further modifications of the channel grooves 20. More specifically, FIG. 16 shows a single groove 20 having a width which is progressively increased from the starting end spaced a distance from the vane end surface 41 adjacent the rotor towards the other vane end surface 42, so that the effective area of the communication passage is gradually increased in accordance with the increment of the width of the channel groove 20 as the vane 4 is gradually projected out of the vane chamber 11. On the other hand, FIG. 17 shows a vane 4 in which five channel grooves, i.e., two longest channel grooves 20*a*, one shortest channel groove 20*c* and intermediate channel grooves 20*b* having a medium length, are formed in symmetry as illustrated. In operation, when the vane 4 is being moved out of the vane chamber 11, the longest grooves 20*a* are brought first into communication with the discharge chamber 10*a* and then the intermediate and the shortest channel grooves 20*b* and 20*c* are successively brought into communication with the discharge chamber 10*a*. In this case, therefore, the effective area of the communication passage is increased stepwise as the vane 4 moves out of the vane chamber 11.

What is claimed is:

1. A rolling piston type rotary machine comprising a cylinder having a cylindrical inner peripheral surface, a rotor disposed in said cylinder in eccentric relationship to the axis of said cylinder and mounted for revolution in rolling contact with said cylindrical inner peripheral surface of said cylinder, said cylinder being formed therein with a vane chamber having an inner part open substantially radially in said cylindrical inner peripheral surface of said cylinder, said cylinder and said rotor cooperating to define therebetween a generally crescent-shaped space movable about the axis of said cylinder by the revolution of said rotor, a radially inwardly biased vane slidably mounted in said vane chamber and having an inner end in sliding contact with the outer peripheral surface of said rotor so that said vane is reciprocally moved as said rotor is revolved, said vane dividing said crescent-shaped space into a suction chamber and a discharge chamber, said vane chamber having an outer part into and out of which said vane is reciprocally moved, said cylinder being further formed therein with a suction port adapted to be open to said suction chamber and a discharge port having an inner end adapted to be opened to said outer part of said vane chamber when said vane is moved toward said crescent-shaped space, said inner part of said vane chamber and said vane being so shaped as to define therebetween a substantially radial communication passage through which said discharge chamber is adapted to be communicated with said outer part of said vane chamber, said discharge port being so positioned relative to said vane that the area of the opening of said discharge port to said outer part of said vane chamber is varied by the reciprocal movement of said vane;

said vane being provided with at least one groove formed in a side of said vane and extending between the inner and outer ends thereof, said groove cooperating with a mating wall of said inner part of said vane chamber to provide said communication passage.

2. A rolling piston type rotary machine according to claim 1, wherein said discharge port is so positioned relative to said vane that said discharge port is closed by said vane at least from the moment when the point of contact between said rotor and said inner peripheral surface of said cylinder reaches said vane at least to the moment when said point of contact is moved past the trailing edge of the opening of said suction port to said suction chamber.

3. A rolling piston type rotary machine according to claim 1, wherein said vane comprises a first generally plate-shaped member and a second member movably attached thereto, said first member being provided with a recess formed in the outer end of said first member remote from said rotor, said second member being received in said recess for movement relative to said first member within a limited range in the direction of reciprocal movement of said vane, the arrangement being such that, when said said rotor is revolved from its top dead center, said first vane member follows the revolution of said rotor and is radially inwardly moved but said second vane member is radially outwardly moved relative to said first vane member within said limited range whereby the timing of the opening of said discharge port to said vane chamber is delayed and such that, when said vane is radially outwardly moved inot said outer part of said vane chamber, said second vane member is fixed to said first vane member and moved therewith.

* * * * *